United States Patent [19]

Sauer

[11] 4,032,871

[45] June 28, 1977

[54] CARRIER FOR CIRCUIT ELEMENTS HAVING CONTACT-MAKING TERMINALS

[75] Inventor: Hans Sauer, Deisenhofen, Germany

[73] Assignees: Hans Sauer, Deisenhofen, Germany; Matsushita Electric Works Ltd., Osaka, Japan; a part interest to each

[22] Filed: July 31, 1975

[21] Appl. No.: 600,805

[30] Foreign Application Priority Data

Feb. 17, 1975 Germany ..... 2506626

[52] U.S. Cl. ..... 335/202; 335/151; 339/206 P; 339/218 C

[51] Int. Cl.[2] ..... H01H 9/02

[58] Field of Search ..... 200/284, 303; 335/106, 335/151, 152, 154, 128, 202; 339/206 R, 206 P, 206 Z, 208, 17 CF, 218 R, 218 C, 218 L, 218 S

[56] References Cited

UNITED STATES PATENTS

| | | | |
|---|---|---|---|
| 3,391,383 | 7/1968 | Antes | 339/17 CF X |
| 3,434,079 | 3/1969 | Ege | 335/202 X |
| 3,480,893 | 11/1969 | Sidor et al. | 335/202 |
| 3,553,729 | 1/1971 | Mori et al. | 335/106 X |

*Primary Examiner*—George Harris
*Attorney, Agent, or Firm*—Cushman, Darby & Cushman

[57] ABSTRACT

A carrier for circuit elements comprises a frame member of insulating material having terminals embedded in it. These terminals have interior portions for connection to circuit elements mounted within the carrier and exterior portions emerging from opposite sides of the frame member in a single plane. Two housing caps are mounted on the frame member to enclose it and the circuit elements.

14 Claims, 18 Drawing Figures

CARRIER FOR CIRCUIT ELEMENTS HAVING CONTACT-MAKING TERMINALS

Figure 1:
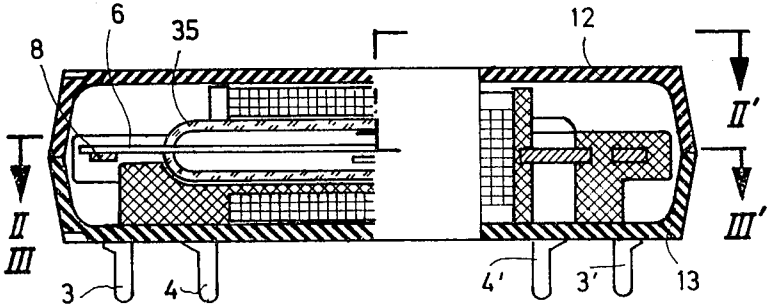

The invention relates to a carrier for circuit elements and including contact-making terminals for such elements.

The invention is based on the need for a carrier that is suitable for receiving various circuit elements and may thus be used for a wide variety of purposes, and in which the circuit elements may be conveniently enclosed in a housing.

To this end the invention consists of a carrier for circuit elements comprising (a) a frame member of insulating material having terminals embedded therein, (b) said terminals having interior portions for connection to circuit elements within the carrier and exterior portions emerging from opposite sides of the frame member in a single plane, and (c) two housing caps mounted on the frame member to enclose the frame member and circuit elements. The invention will be explained in detail hereinafter with reference to the embodiments thereof illustrated in the drawings.

Figure 4:
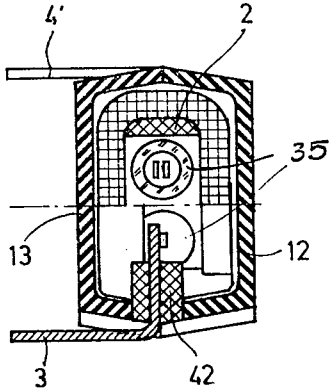
Figure 2:
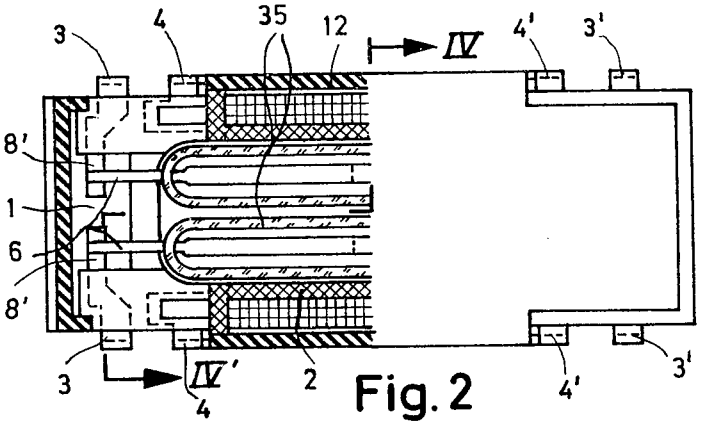
Figure 5:
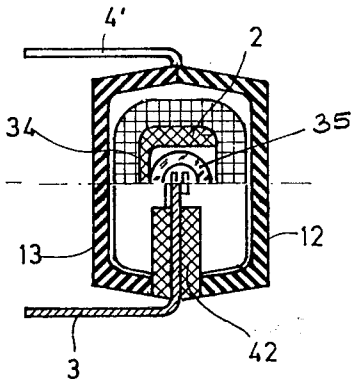
Figure 3:
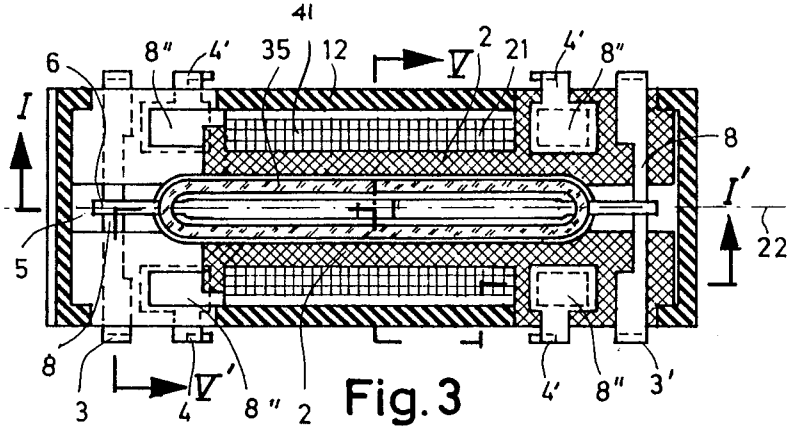
Figure 6:
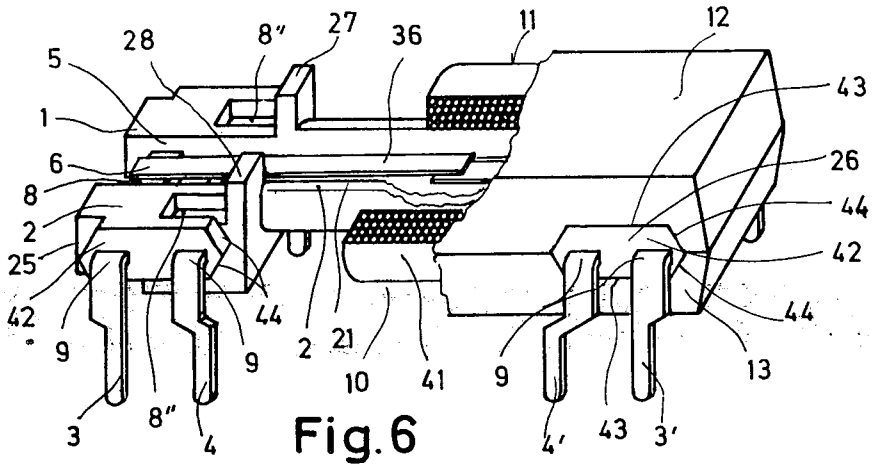

FIGS. 1 to 6 show carriers which are constructed as coil bodies for relays and which are covered by two opposite housing caps;

FIG. 1 being a section on I–I' in FIG. 3;

FIG. 2 being a section on II–II' in FIG. 1 of one embodiment;

FIG. 3 being a section on III–III' in FIG. 1 of a different embodiment (both embodiments having the same appearance in the FIG. 1 view);

FIG. 4 being a section on IV–IV' in FIG. 2;

FIG. 5 being a section on V–V' in FIG. 3;

and FIG. 6 being a cut-away perspective view of a further embodiment.

Figure 7:
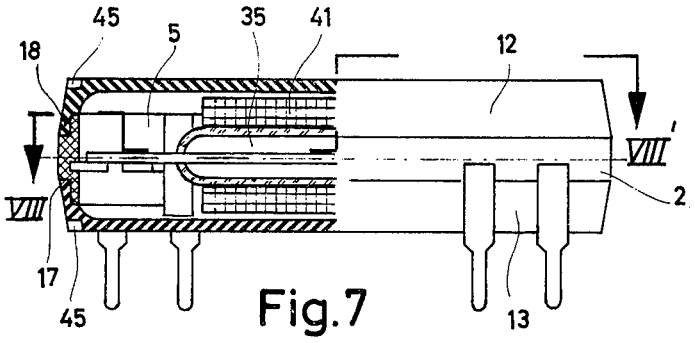
Figure 8:
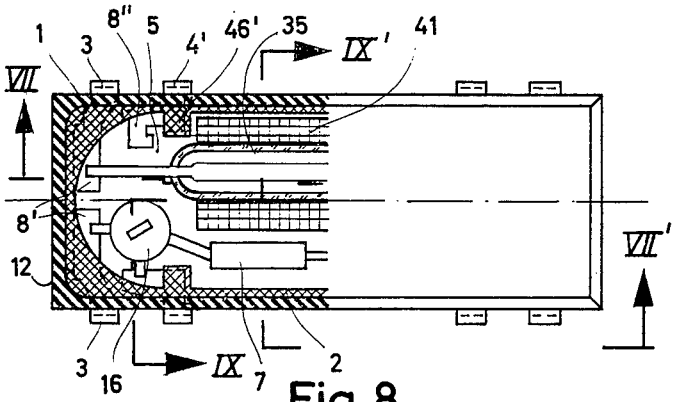
Figure 9:
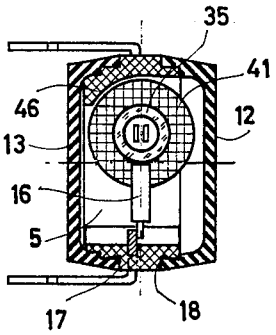

FIGS. 7 to 10 show a carrier whose interior is covered by two opposite housing caps mounted on the frame;

FIG. 7 being a section on VII–VII' in FIG. 8;

FIG. 8 being a section on VIII–VIII' in FIG. 7;

FIG. 9 being a section on IX–IX' in FIG. 8 and

Figure 10:
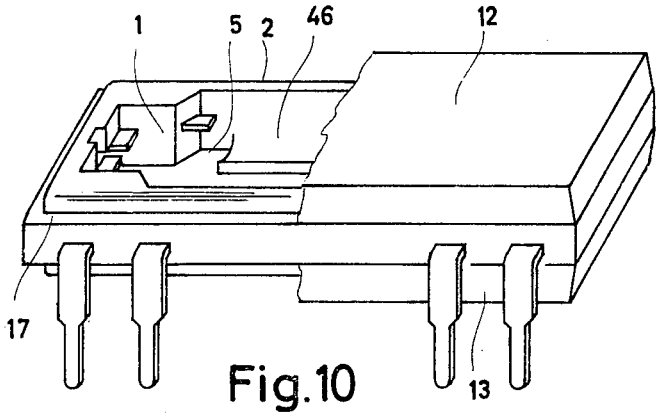

FIG. 10 being a cut-away perspective view of the embodiment of FIGS. 7 to 9.

Figure 11:
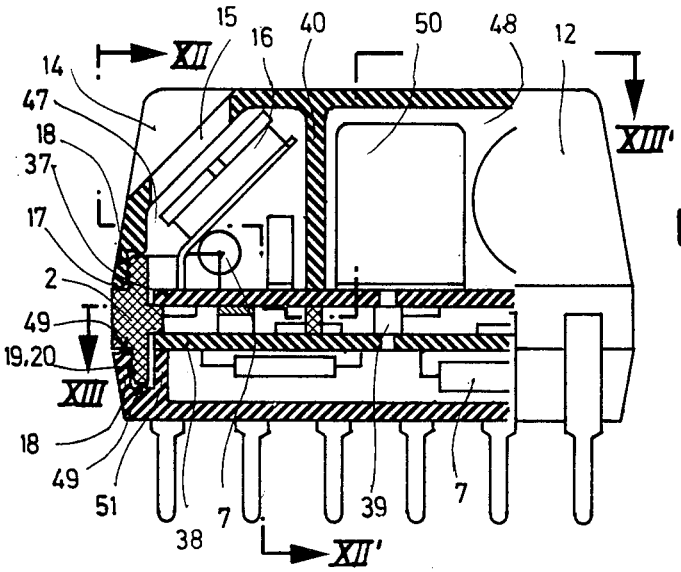
Figure 12:
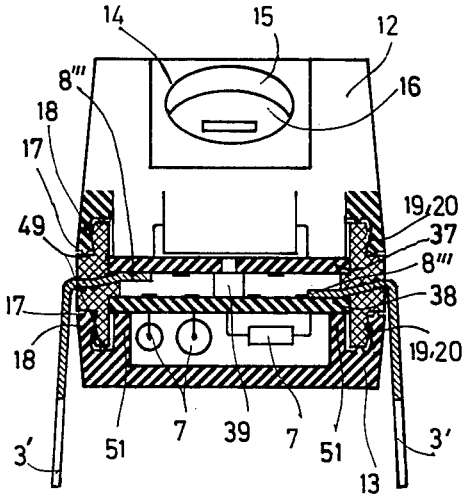
Figure 13:
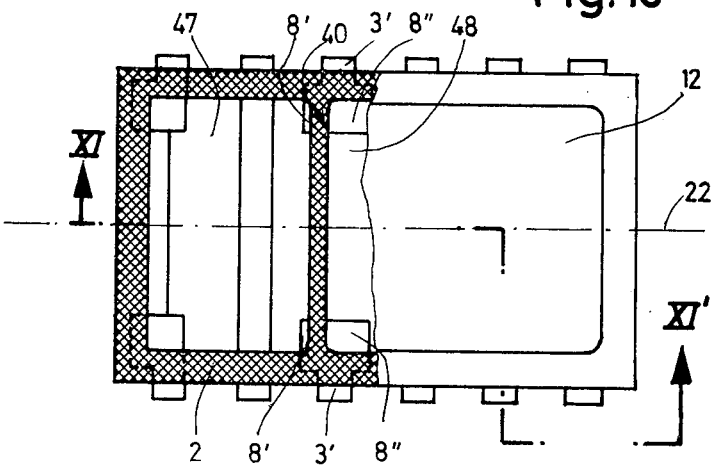

FIGS. 11 to 14 show a carrier which is divided by an intermediate wall extending perpendicularly to the longitudinal axis;

FIG. 11 being a section on XI–XI' in FIG. 13;

FIG. 12 being a section on XII–XII' in FIG. 11;

FIG. 13 being a section on XIII–XIII' in FIG. 11 and

Figure 14:
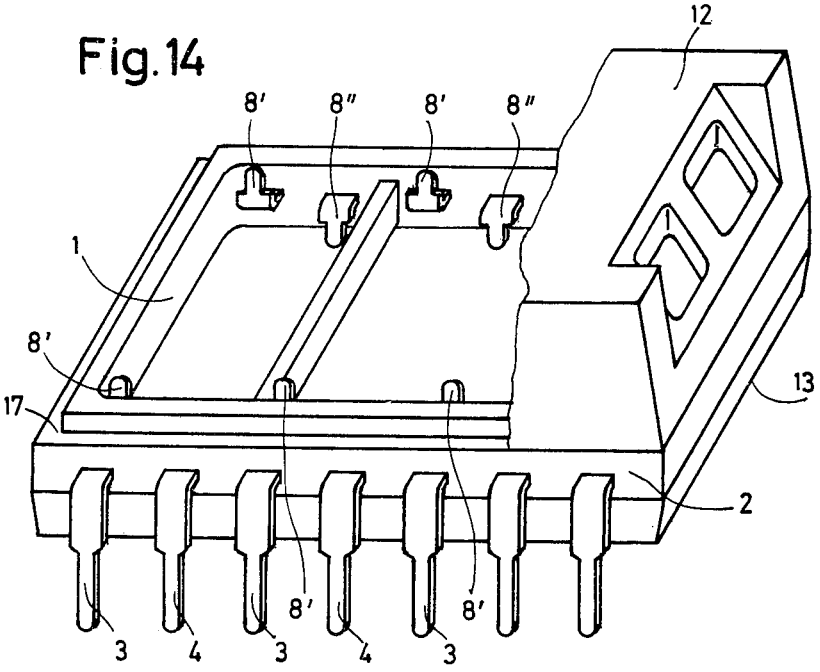

FIG. 14 being a cut-away perspective of the embodiment of FIGS. 11 to 13.

Figure 15:
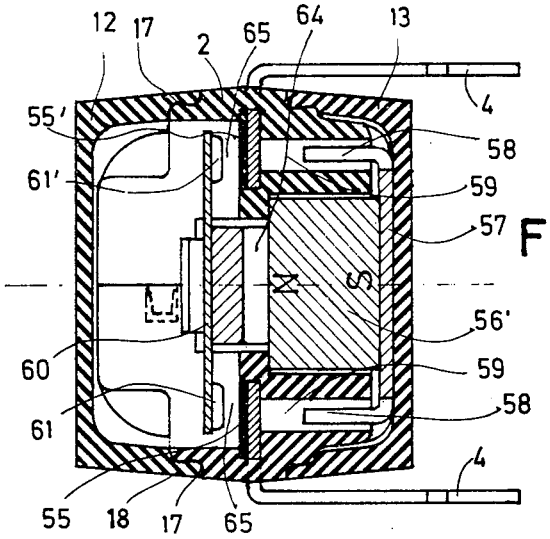
Figure 16:
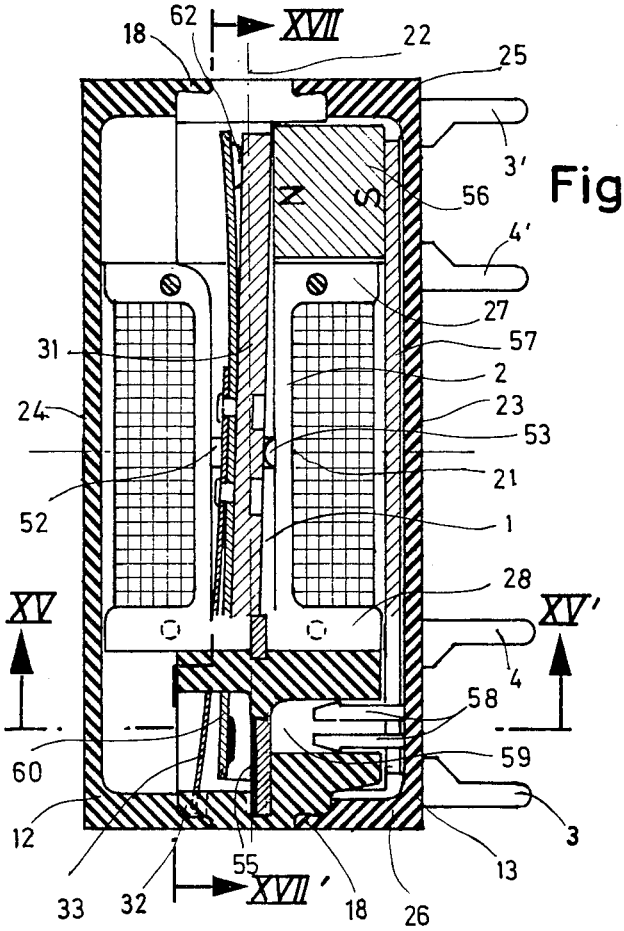
Figure 17:
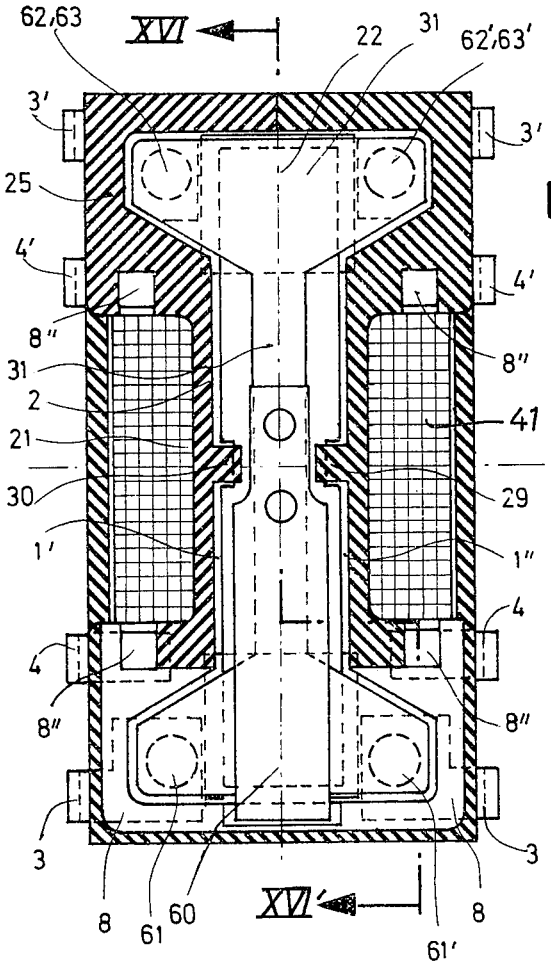

FIGS. 15 to 17 show a carrier which is constructed as a coil body for a relay and in the centre portion of which bearing points are formed for a relay armature;

FIG. 15 being a section on XV–XV' in FIG. 16;

FIG. 16 being a section on XVI–XVI' in FIG. 17;

FIG. 17 being a section on XVII–XVII' in FIG. 16 and

Figure 18:
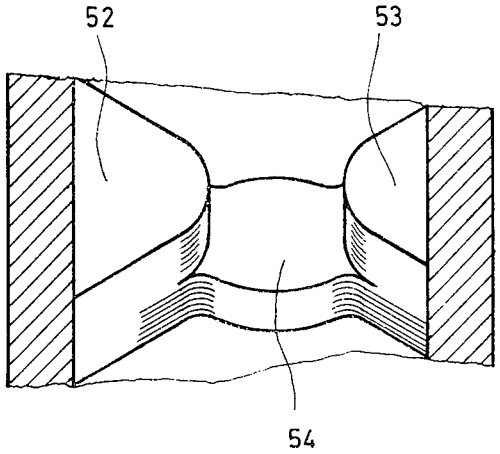

FIG. 18 being a fragmentary perspective of a portion of the embodiment of these figures. In the embodiments according to FIGS. 1 to 6 the carrier 1 takes the form of a coil body or spool for a so-called reed relay. In all cases the carrier 1 consists substantially of a frame member 2 with embedded contact terminals 3, 3', 4, 4'. In the interior 5 the terminals 3, 3' have portions 8, 8' adapted for connection to terminals 6 of reed contact devices 35 or 36. The contact terminals 4, 4' are provided in the interior 5 with exposed portions 8'' to which terminals of the relay winding 41 or connections of diodes (not illustrated, but also accommodated in the interior 5) may be connected. The contact terminals 3, 3', 4, 4', emerge from opposite sides 10, 11 of the frame member with their free ends 9 (FIG. 6) lying, before bending, in a single plane. To provide the necessary space for the relay winding 41 the central portion 21 of the frame member 2 is located closer to the longitudinal axis 22 thereof than at the end regions 25, 26. Additionally, coil flanges 27, 28 are formed on both sides between the central portion 21 of the frame member 2 and the ends 25, 26 of the carrier 1. The interior 5 and the reed contact devices 35 or 36 therein are enclosed by a pair of housing caps 12, 13. The housing caps 12, 13 are identical in construction and are joined together by ultrasonic welding. In the regions where they emerge from the frame member 2 the contact terminals 3, 3', 4, 4' are embedded in sleeve-like integrally formed material portions 42 so that the terminals need not be directly sealed with respect to the housing caps. The portions 42 are provided on opposite sides with planar support surfaces 43 and with support surfaces 44 inclined to the plane of the terminals for engaging the housing caps 12, 13, thus making hermetic sealing of the interior possible.

The construction of the carrier 1 according to the examples illustrated in FIGS. 1 to 6 results in particularly economically produceable reed relays. The carrier 1 is at the same time the carrier of the reed contact device 35, 36, the winding 41 and the housing caps 12, 13.

In the embodiment according to FIGS. 2 and 4 two glass encased reed contact devices 35 are provided which between their connections to the exposed portions 8', for example by spot welding, extend freely within the winding 41 so that no damaging effect on the glass tube by the winding is possible.

In the reed relay illustrated in FIGS. 3 and 5 only one reed contact device 35 is provided. To accommodate it the carrier 1 is formed with a U profile at its central portion 21 of the frame member 2 on both sides of the longitudinal axis 22, and a base plate 34 joining the frame member 2.

The construction of the embodiment according to FIG. 6 is similar, but in this case an open and thus adjustable reed contact device 36 is mounted in the carrier interior 5.

FIGS. 7 to 10 show a carrier 1 whose interior 5 is sealed by identical housing caps 12, 13 mounted on the frame member 2. As apparent from FIGS. 7, 9 and 10 the support surfaces 17 provided for the housing caps 12, 13 on the frame member 2 and the edges 18 of the housing caps 12, 13 in contact with said support surfaces are stepped to fit together. Due to the lateral location of the housing caps 12, 13 on the frame member 2 achieved by this fit, if hermetic enclosure of the interior 5 can be dispensed with, securing can be obtained by applying adhesive to the support 17 on the frame member 2, instead of by welding. Disposed in the interior 5 is a glass enclosed reed contact device 35 which is wound with an energizing coil 41, and further circuit elements 7, including for example a potentiometer 16 for adjusting the response values. To support and secure the energizing coil 41, which may, for example, be wound from baked lacquer wire, flanges 46, 46' are integrally formed on the frame member 2 and are shaped to the contour of the coil. The terminals of the reed contact device 35 and the potentiometer 16 are connected by spot welding to exposed portions 8′ of the contact terminals 3, 3′. The exposed portion 8″ of the contact terminal 4″ for connection of the winding 41 is bent to enable the coil wire to be suspended therein or fixed thereon by bending round and soldering. To prevent the component being erroneously mounted laterally inverted in the housing, which may be possible because of its symmetrical structure, markings 45 may be formed in the housing caps 12, 13 in the region of their end faces.

The construction of the carrier 1 shown in FIGS. 7 to 10 produces reed relays that are even more simplified than the embodiments illustrated in FIGS. 1 to 6 and which are therefore particularly suitable for industrial mass production. The additional advantage is achieved that the relay can be adapted to a large number of uses by replacing the circuit elements 7 or the potentiometer 16 by other circuit elements, such as resistors, diodes, capacitors or amplifying elements, such as transistors. Consequently, with low production expenditure a wide type range of reed relays can be made available, subject to the power capacity of the reed contact device 35 used in each case.

FIGS. 11 to 14 show further developments of the carrier 1 for accommodating a larger number of circuit elements 7 which are mounted at least partially on two side plates 37, 38. For this purpose the exposed portions 8′, 8″ of the contact terminals 3, 4 in FIG. 14 are arranged within the carrier 1 in two respective parallel planes, one of the circuit boards 37, 38 lying in each of these planes. As apparent from FIG. 12, the locating of the circuit boards 37, 38 is effected by exposed portions 8‴ of contact terminals 3′. Portions 8‴ lie in parallel planes.

The bending of said portions 8‴, the degree of which determines the spacing of the two circuit boards 37, 38, is produced in a simple manner during the injection molding, pressing or transfer molding operation by the production tool. The circuit boards 37, 38 permit the number of circuit elements which can be accommodated to be increased considerably, because the circuit elements are no longer confined to the available exposed portions 8′, 8″, 8‴ of the contact terminals 3, 3′, 4, 4′. For electrically connecting the two circuit boards 37, 38, an internal electrical connection 39 is provided. The housing caps 12, 13 are made unequal in the embodiment according to FIGS. 11 to 14. In particular the housing cap 12 and the carrier 1 are divided by a partition 40 extending perpendicularly to the longitudinal axis 22 of the carrier. Apart from dividing the interior 5, said partition 40 also stiffens the housing cap 12 and the frame member 2. In the first chamber 47 of the housing cap 12, in the region of one of the end faces 14 thereof, an opening 15 is formed through which a potentiometer 16 disposed in said chamber is accessible for adjustment. Accommodated in the second chamber 48 are the circuit elements required to perform the desired operation.

For example, such an arrangement is used to produce a pick-up or drop-out delay for a relay 50 also mounted in the interior of the carrier. The desired delay time is adjustable with the aid of the potentiometer 16. The signal transfer from the first chamber 47 to the second chamber 48 is via the exposed portions 8′, 8″ of the contact terminals 3′ which extend out from the partition 40 on both sides.

The enclosing of the interior 5 by the housing caps 12, 13 is effected in the embodiment according to FIGS. 11 to 14 in that the step-like edges 18 of the housing caps and support surfaces 17 on the frame member 2 are provided on two opposite sides with inclined faces 19, 20 suitable for mutual locking. As a result, a secure hold is provided after placing the housing caps 12, 13 on the frame member 2. Additionally, ultrasonic welding may be employed. With such a welding, web-like protuberances 49 disposed at the edges 18 of the housing caps 12, 13 opposite the support surfaces 17 of the frame member 2 are deformed and the housing caps 12, 13 fused to the frame member 2 in a gas-tight manner in the region of these support surfaces. At the same time, one or both circuit boards 37, 38 is retained by projections 51 integrally formed on the inside of the housing caps 12, 13.

The embodiment according to FIGS. 15 to 17 again comprises a carrier 1 which is constructed as a coil body for a relay, and the central portion 21 of the frame member 2 of which is located closer to the longitudinal axis 22 than at the end regions 25, 26, and in which coil flanges are formed between the central portion 21 and the end regions 25, 26. The carrier 1 consists of two identical parts 1′, 1″ in the central portion 21 of each of which bearing points 29, 30 are provided for a relay armature 31. One half of this mounting, which is part of each part, is illustrated in detail in FIG. 18. It consists substantially of two opposite convex portions 52, 53 which determine the bearing play, and a web 54 which connects the convex portions and on which the armature 31 rests. In view of the provision of the relay contacts 55 and a reset spring 33 mounted on the armature, the convex portions 52, 53 in the present case are not identical. The so-called X mounting formed by them has a low bearing friction and may be economically made because of its simple structure.

Furthermore, contact terminals 3, 3′, 4, 4′ and their exposed portions 8, 8″ are accommodated in the carrier 1 which is constructed as a frame member, the portions 8 being covered with contact material and serving as fixed contacts. Permanent magnets 56, 56′ are also located in the ends 25, 26 of the frame member 2 in spaces provided for them. Associated with the permanent magnets 56, 56′ is a yoke 57 which is also mounted on the frame member 2. For this purpose, noses 58 are integrally formed on the yoke 57 and engaged in corresponding recesses 59 in the ends 25, 26 of the frame member 2. In addition, the frame member has a recess 32 in which the free end of the reset spring 33 mounted on the armature 31 is supported. To obtain a reliable tight enclosure of the interior 5 the support surfaces 17 provided on the frame member 2 for the housing caps 12, 13 and the edges 18, have a step, producing a locking effect. For hermetic sealing the joint may be welded.

The relay illustrated in FIGS. 15 to 17 is shown in the unenergized state. In this position the armature reset spring 33 effects a constrained opening of the fixed contacts 55, 55′ and the contacts 61, 61′ disposed at one end 60 of the armature 31. The double break provides a large contact air gap and thus a high voltage capacity between the fixed contacts 55, 55′. The contacts 62, 62′ preferably mounted resiliently at the other end of the armature 31 rest in this armature position on the fixed contacts 63, 63′ associated therewith. An advantage of this arrangement is that the force of the permanent magnet 56 adds to the force of the armature reset spring 33, giving a high rest contact force. When the relay is energized, the armature 31 performs a rotational or tilting movement about the bearing formed by the convex portions 52, 53 so that the contacts 55, 61 and 55', 61' at the end 60 of the armature 31 are closed and the contacts 62, 63 and 62', 63' at the other end of the armature 31 are opened. With regard to contact reliability the armature air gap 64 is made larger than the spacing 65 between the contacts 55, 61 and 55', 61' (FIG. 15). In the contact system 62, 62', 63, 63', a double break occurs in this switching operation.

What is claimed is:

1. A carrier for circuit elements comprising:

a. a frame member of insulating material having terminals embedded therein;

b. said terminals having interior portions for connection to circuit elements within the carrier and exterior portions emerging from opposite sides of the frame member in a single plane;

c. two housing caps mounted on the frame member to enclose the frame member and circuit elements; and d. said frame member having support surfaces provided on the frame member for the housing caps, the edges of the housing caps contacting said support surfaces and said edges and support surfaces constructed to fit into each other in a stepped manner.

2. A carrier according to claim 1, wherein one of the housing caps has substantially the form of a hollow parallelepiped and has an opening in the region of one of its end faces through which a potentiometer disposed in the contact carrier is accessible.

3. A carrier according to claim 1 constructed as a coil body for a relay, the frame member at a central portion thereof having two sides positioned closer to a longitudinal axis than at end areas thereof.

4. A carrier according to claim 3, wherein coil body flanges are formed between the central portion of the frame member and the end areas.

5. A carrier according to claim 3, wherein the relay coil body consists of two identical parts.

6. A carrier according to claim 5, wherein bearing points for a relay armature are integrally formed in the central portion.

7. A carrier according to claim 3, wherein a recess for supporting a free end of an armature reset spring is formed in the frame member.

8. A carrier according to claim 3, wherein, in the central portion, a U profile is formed by the frame member extending on both sides of the longitudinal axis and by a base plate joining the frame member for accommodating at least one contact device.

9. A carrier according to claim 1, wherein the interior portions of the terminals within the carrier are disposed in two parallel planes and, a circuit board serving to mount circuit elements being located in each of said planes.

10. A carrier according to claim 9, wherein the two circuit boards are electrically interconnected with a continuous internal connection.

11. A carrier according to claim 1, wherein at least one of the housing caps and the carrier is divided by a partition extending perpendicularly to the longitudinal axis of the carrier.

12. A carrier according to claim 11, wherein a contact terminal is provided having portions which emerge on both sides from said partition.

13. A carrier according to claim 1, wherein said exterior portions of the terminals outside the frame member are bent to extend at right angles to said plane and parallel to each other.

14. A carrier according to claim 1, wherein the two housing caps are welded to the frame member.

* * * * *